US009897404B2

(12) United States Patent
Geissele

(10) Patent No.: US 9,897,404 B2
(45) Date of Patent: Feb. 20, 2018

(54) RECOIL SPRING FOR A FIREARM

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 15/215,582

(22) Filed: Jul. 20, 2016

(65) Prior Publication Data

US 2017/0268839 A1 Sep. 21, 2017

Related U.S. Application Data

(63) Continuation-in-part of application No. 29/558,586, filed on Mar. 18, 2016, now abandoned.

(51) Int. Cl.

| | |
|---|---|
| ***F41A 3/00*** | (2006.01) |
| ***F41A 3/86*** | (2006.01) |
| ***F41A 3/54*** | (2006.01) |
| ***F41A 3/66*** | (2006.01) |

(52) U.S. Cl.
CPC ..... *F41A 3/86* (2013.01); *F41A 3/54* (2013.01); *F41A 3/66* (2013.01)

(58) Field of Classification Search
USPC ..... 42/14, 16; 89/145, 4.05, 4.5, 194, 199
See application file for complete search history.

(56) References Cited

U.S. PATENT DOCUMENTS

| | | | | |
|---|---|---|---|---|
| 2,476,328 | A | 7/1949 | Simpson | |
| 2,504,958 | A | 4/1950 | Botts | |
| 3,661,049 | A | 5/1972 | Perrine | |
| 3,756,162 | A * | 9/1973 | Wulff | B61F 5/06 105/198.2 |
| 3,857,325 | A | 12/1974 | Thomas | |
| 4,673,170 | A | 6/1987 | Dykema | |
| D349,323 | S | 8/1994 | Howard | |
| 5,392,689 | A | 2/1995 | Buzzeo | |
| 6,235,131 | B1 * | 5/2001 | Keihle | C21D 1/40 148/320 |
| 6,481,143 | B2 | 11/2002 | McCarthy | |
| 6,968,770 | B2 | 11/2005 | Barfield | |
| D530,188 | S | 10/2006 | Kalat | |

(Continued)

OTHER PUBLICATIONS

Heavy Spring for the SCAR Hammer, no date available, [online], [site visited Dec. 27, 2016]. Retrieved from <Url:https://geissele.com/heavy-spring-for-the-scar-hammer.html>.

AK recoil spring from ALG Defense, Youtube, Feb. 19, 2016, [on line], [site visited Jan. 19, 2017]. Retrieved from <Url:https://www.youtube.com/watch?v=hzoQAhVxQDO>.

ALG Defense Recoil Spring AK-47, Midway, no date available, [online], [site visited Jan. 19, 2017]. Retrieved from <U rl :http://www. m idwayusa.com/product/22677 4/alg-defense-recoil-spri ng-ak-4 7-ak-7 4-ch rome-silicon>.

(Continued)

*Primary Examiner* — John W Eldred
(74) *Attorney, Agent, or Firm* — Merchant & Gould, P.C.

(57) ABSTRACT

A firearm includes a receiver for housing a trigger mechanism. The receiver is attached to a firearm barrel, and the receiver includes a bolt carrier that is configured to reciprocate therein. The firearm includes a recoil spring that has a first end and a second end, and the first end interfaces with the bolt carrier. The recoil spring further includes a dampened portion positioned between the first and second ends. The dampened portion has a plurality of dead spring coils. The firearm also includes a spring retainer that is configured to retain the recoil spring within the firearm.

11 Claims, 7 Drawing Sheets

(56) References Cited

U.S. PATENT DOCUMENTS

| | | | | |
|---|---|---|---|---|
| D532,292 | S | 11/2006 | Duwel | |
| 7,347,754 | B1 | 3/2008 | Cheung | |
| 7,546,816 | B2 | 6/2009 | Gabriel | |
| 8,132,350 | B1 | 3/2012 | Alves | |
| 8,844,425 | B2 | 9/2014 | Mueller | |
| 8,991,374 | B1 * | 3/2015 | Conkel | F41B 5/126 124/23.1 |
| 2009/0031607 | A1 * | 2/2009 | Robinson | F41A 3/26 42/16 |
| 2010/0251588 | A1 | 10/2010 | Kincel | |
| 2011/0226646 | A1 * | 9/2011 | Wyrick | 206/365 |
| 2012/0042555 | A1 | 2/2012 | Alves | |
| 2014/0373708 | A1 | 12/2014 | Wood | |
| 2015/0190913 | A1 | 7/2015 | Williams | |
| 2015/0192380 | A1 | 7/2015 | Hilsabeck | |
| 2015/0330728 | A1 * | 11/2015 | McGinty | F41A 3/84 89/198 |
| 2016/0370139 | A1 | 12/2016 | Geissele | |

OTHER PUBLICATIONS

Progressive Suspension 11-1523 18, Feb. 1, 2007, [online], [site visited Jan. 13, 2017]. Retrieved from <Uri :https://www.amazon.com/Progressive-Suspension-11-1523-18-5-Spring/dp/BOOOGUOAAE>.

Compression Tension Spring, as archived by the Internet Archive Wayback Machine, May 1, 2013, [online], [site visited Feb. 6, 2017]. Retrieved from <U rl :https ://web.arch ive.org/web/20130501 0651 06/http ://autos pg.manufacturer .globalsou rces.com/si/600880139081 9/pdtl/Tension-spring/1006721820/Compression-Tension-Spring.htm>.

ALG AK Recoil Spring, as Archived by the Wayback Machine, Jan. 21, 2016, [online], [site visited Feb. 6, 2017]. Retrieved from <U rl :https://web.arch ive.org/web/201 60121 004042/http ://algdefense.com/ak-recoi l-spring. htm l>.

ALG AK Recoil Spring, no date available, [online], [site visited Feb. 15, 2017]. Retrieved from <Uri: https://algdefense.com/akrecoil-spring.html/>.

* cited by examiner

RECOIL SPRING FOR A FIREARM

CROSS-REFERENCE TO RELATED APPLICATIONS

This application is a continuation-in-part of U.S. patent application Ser. No. 29/558,586 filed Mar. 18, 2016, and titled FIREARM RECOIL SPRING, the disclosure of which is incorporated herein by reference in its entirety.

BACKGROUND

Firearms are configured to fire rounds of ammunition. To fire a firearm, the user of the firearm can pull a trigger mechanism, which releases a hammer. The hammer is designed to then strike a firing pin which, in turn, strikes an impact sensitive round of ammunition. Once struck, the round of ammunition expels a projectile (e.g., a bullet) from the barrel of the firearm toward a target.

When a firearm is discharged, a plurality of internal components move together as part of a firing cycle. Over time, movement of the internal components can cause components to wear. Worn components in a firearm can cause the firearm to malfunction and can cause the firearm to be less reliable. Reducing wear between the components can lead to the improved operation and longevity of the firearm.

SUMMARY

The present disclosure relates generally to a recoil spring for a firearm. In one possible configuration, and by non-limiting example, the recoil spring includes a plurality of dead coils.

In one aspect of the present disclosure, a firearm is disclosed. The firearm includes a receiver for housing a trigger mechanism. The receiver is attached to a firearm barrel, and the receiver includes a bolt carrier that is configured to reciprocate therein. The firearm includes a recoil spring that has a first end and a second end, and the first end interfaces with the bolt carrier. The recoil spring further includes a dampened portion positioned between the first and second ends. The dampened portion has a plurality of dead spring coils. The firearm also includes a spring retainer that is configured to retain the recoil spring within the firearm.

In another aspect of the present disclosure, a recoil spring assembly for a firearm is disclosed. The recoil spring assembly includes a spring guide that has a base and a spring guide rod. The spring guide rod is attached at and extending away from the base. The base is configured to be mounted to a firearm. The recoil spring assembly includes a recoil spring that is positioned around the spring guide rod. The recoil spring has a first end and a second end. The first end is retained around the spring guide rod by way of a fastener secured to the spring guide rod. The second end of the recoil spring interfaces with the base of the spring guide, and the recoil spring further includes a dampened portion positioned between the first and second ends. The dampened portion includes a plurality of dead spring coils.

In another aspect of the present disclosure, a recoil spring for a firearm is disclosed. The recoil spring includes a first end and a second end. The first end is configured to interface with a bolt carrier of a firearm, and the second end is configured to be fixedly mounted to the firearm. The recoil spring includes a dampened portion positioned between the first and second ends. The dampened portion has a plurality of dead spring coils.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
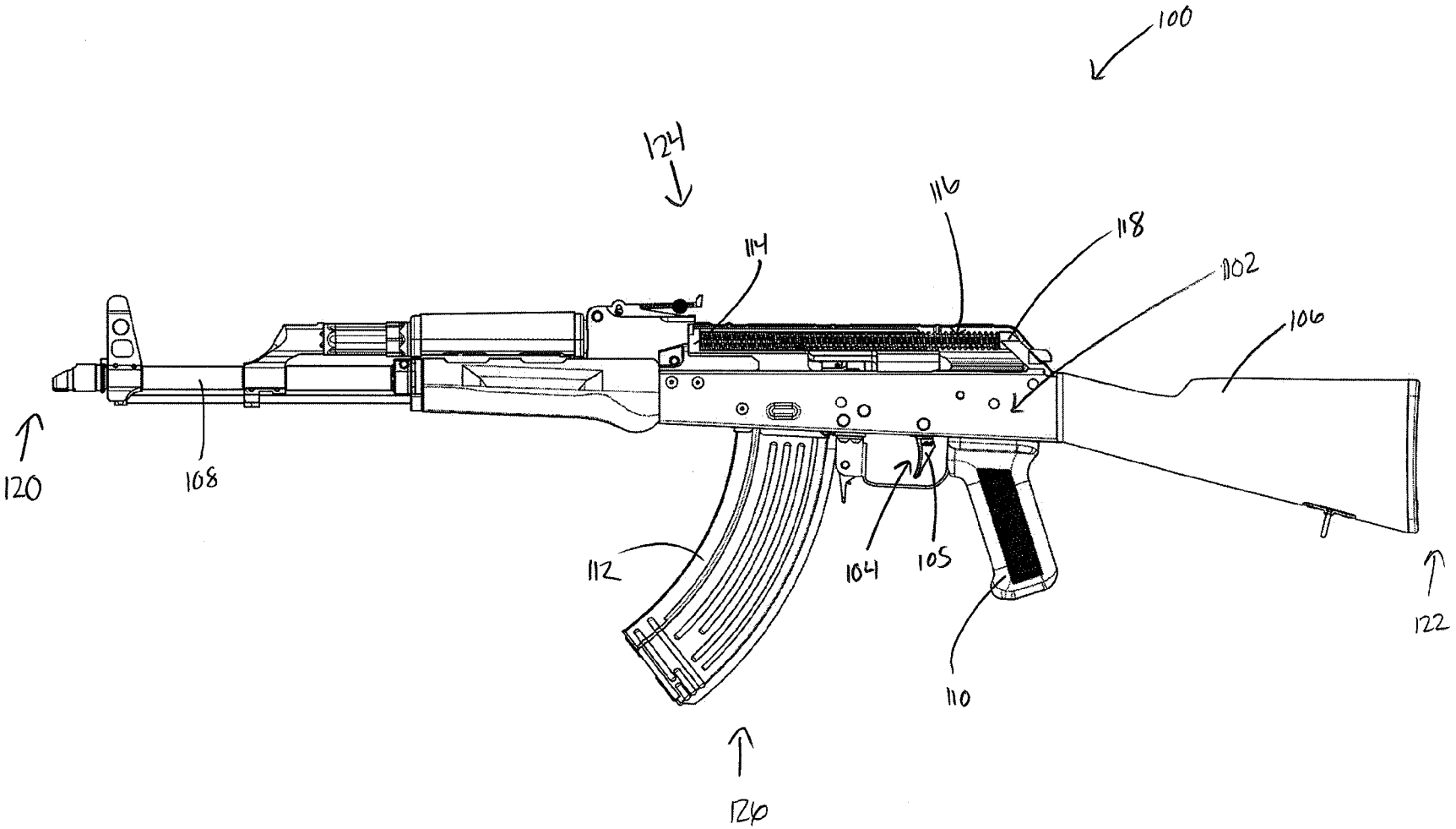
FIG. 1 illustrates a side view of an example firearm, including a partial cut-away of an example firearm receiver, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A recoil spring described herein is configured to improve reliability and operation of a firearm. Specifically, the recoil spring includes a plurality of dead coils that help extend the life of the spring. Further, the dead coils can aid in reducing recoil forces during the firing cycle.

FIG. 1 illustrates a schematic left side view of an example firearm 100 according to one embodiment of the present disclosure. In this example, the firearm 100 includes a receiver 102, a trigger mechanism 104, a stock 106, a barrel 108, a grip 110, and an ammunition magazine 112. Further, for illustrative purposes, a cut out is depicted in the receiver 102 to show a bolt carrier 114, a recoil spring 116, and a spring guide 118.

The firearm 100 is defined by a front 120, a rear 122, a top 124, and a bottom 126. Throughout this disclosure, references to orientation (e.g., front(ward), rear(ward), in front, behind, above, below, high, low, back, top, bottom, under, underside, etc.) of structural components shall be defined by that component's positioning in FIG. 1 relative to, as applicable, the front 120, the back 122, the top 124, and the bottom 126 of the firearm 100, regardless of how the firearm 100 may be held and regardless of how that component may be situated on its own (i.e., separated from the firearm 100).

In some examples, the firearm 100 is configured to have a plurality of operating modes. Examples of operating modes include a semi-automatic mode. In semi-automatic mode, the trigger mechanism 104 automatically resets after firing each round of ammunition. In some embodiments, the firearm 100 has a safe mode. In the safe mode, the firearm 100 is prevented from discharging a round of ammunition.

The firearm 100 can be of a variety of types. Examples of a firearm include handguns, rifles, shotguns, carbines, and personal defense weapons. In at least one embodiment, the firearm is an AK-47 rifle or a variant of the AK-47. In at least one embodiment, the firearm 100 is an M4 carbine or a variant of an M4 carbine. In at least one embodiment, the firearm is a Colt AR-15 rifle or a variant of the AR-15.

The receiver 102 is configured to house a firing mechanism and associated components as found in, for example, assault rifles and their variants. The firing mechanism includes a trigger mechanism 104, which is described and illustrated in more detail with reference to FIGS. 2-13.

The trigger mechanism 104 includes a trigger bow 105 configured to be pulled by the finger of the shooter (e.g., the index finger) to initiate the firing cycle sequence of the firearm 100. The trigger mechanism 104 is mounted to the receiver 102. The trigger mechanism 104 is configured to discharge the firearm 100 when a predetermined amount of force is applied to the trigger bow 105. The trigger mechanism 104 can be designed to replace the OEM trigger mechanism of the firearm 100, such as assault type rifles, and provide multiple shooting modes, or can be designed as an OEM trigger mechanism. The trigger mechanism 104 is installed in the receiver 102.

The stock 106 is configured to be positioned at the rear 122 of the firearm 100. The stock 106 provides an additional surface for a shooter to support the firearm 100, preferably against the shooter's shoulder. In some embodiments, the stock 106 includes a mount 107 for a sling. In other embodiments, the stock 106 is a telescoping stock. In other embodiments still, the stock 106 is foldable. In some embodiments, the stock 106 is removably mounted to the receiver 102. In at least one embodiment, the stock 106 is threaded to the receiver 102. In other embodiments, the stock 106 is secured to the receiver 102 by one or more fasteners.

The barrel 108 is positioned at the front 120 of the firearm 100 and is configured to be installed on the receiver 102. The barrel 108 provides a path to release an explosion gas and propel a projectile therethrough. In some embodiments, the barrel 108 includes an accompanying assembly that includes one or more of a rail system for mounting accessories (e.g., a fore-grip, a flashlight, a laser, optic equipment, etc.), a gas block, and a gas tube.

The grip 110 provides a point of support for the shooter of the firearm and can be held by the shooter's hand, including when operating the trigger mechanism 104. The grip 110 assists the shooter in stabilizing the firearm 100 during firing and manipulation of the firearm 100. In some embodiments, the grip 110 is mounted to the receiver 102.

The magazine 112 can be an ammunition storage and feeding device within the firearm 100. In at least one embodiment, the magazine 112 is detachably installed to the firearm 100. For example, the magazine 112 is removably inserted into a magazine well of the receiver 102 of the firearm 100.

As noted above, the bolt carrier 114 is configured to slide within receiver 102 during the firing cycle. Specifically, the bolt carrier 114 is equipped to move in a direction toward the rear portion 122 of the firearm 100 and then in a forward direction toward the front 120 of the firearm 100.

The recoil spring 116 is configured to help reset the bolt carrier 114 during a firing cycle. The recoil spring 116 is mounted between a fixed surface at the rear 122 of the firearm and the movable bolt carrier 114. The recoil spring 116 receives the bolt carrier 114 after a round of ammunition has been fired. The bolt carrier 114 is forced to the rear 122 of the firearm 100 after a round of ammunition is discharged, and the recoil spring 116 compresses as the bolt carrier 114 continues to move to the rear 122. The recoil spring 116 then stops the rearward movement of the bolt carrier 114, and then the recoil spring 116 forces the bolt carrier 114 in a direction toward the front 120 of the firearm 100.

The spring guide 118 is configured to help guide and retain the recoil spring 116 within the receiver 102. The recoil spring 116 is mounted to a portion of the spring guide 118 and the spring guide 118 is mounted to the receiver 102. In some embodiments, the spring guide 118 is removably fixed to the receiver 102. In other embodiments, the spring guide is a buffer tube (not shown).

Other embodiments of the firearm 100 have other configurations than the examples illustrated and described with reference to FIG. 1. For example, some of the components listed above are not included in some alternative embodiments.

Figure 2:
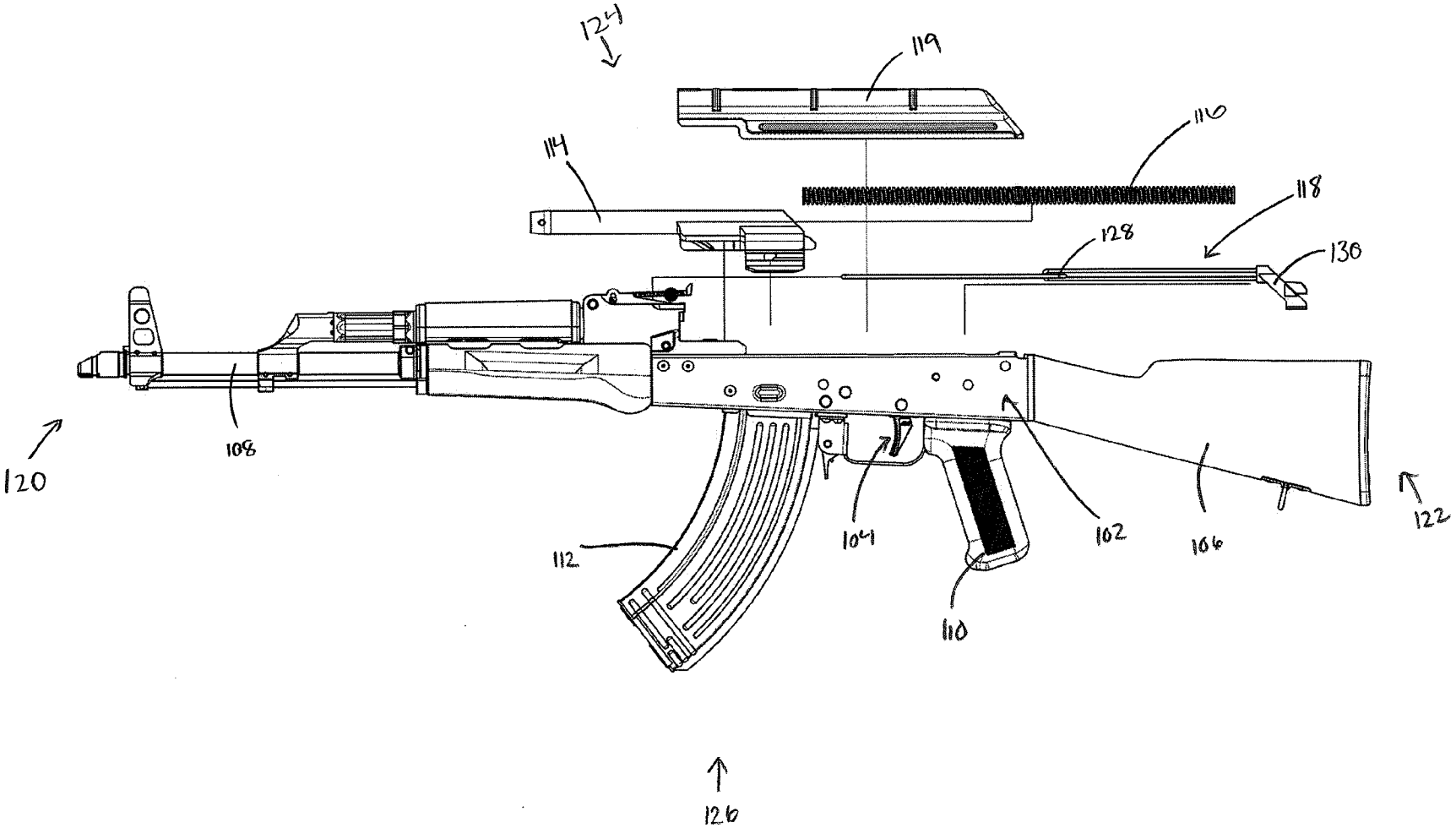
FIG. 2 illustrates an exploded side view of the example firearm of FIG. 1.

FIG. 2 illustrates an exploded view of the firearm 100. The bolt carrier 114, recoil spring 116, spring guide 118, and a top cover 119 are shown removed from the firearm 100. To assemble the firearm 100, the bolt carrier 114 is first inserted into the receiver 102. In some embodiments, the recoil spring 116 is installed on the spring guide 118. In the depicted embodiment, the spring guide 118 includes a spring guide rod 128 and a base 130. The recoil spring 116 is first installed around the spring guide rod 128. In some embodiments, once the recoil spring 116 is installed around the spring guide rod 128, a fastener (not shown) is used to retain the recoil spring 116 around the spring guide rod 128.

Once assembled, the recoil spring 116 and spring guide 118 are inserted into the receiver 102. Due to the design of the bolt carrier 114, a portion of the spring 116 and the spring guide rod 128 are installed within a portion of the bolt carrier 114. The base 130 of the spring guide 118 is then secured to the receiver 102. The top cover 119 is then installed on the receiver 102 over the bolt carrier 114, recoil spring 116, and spring guide 118.

Figure 3:
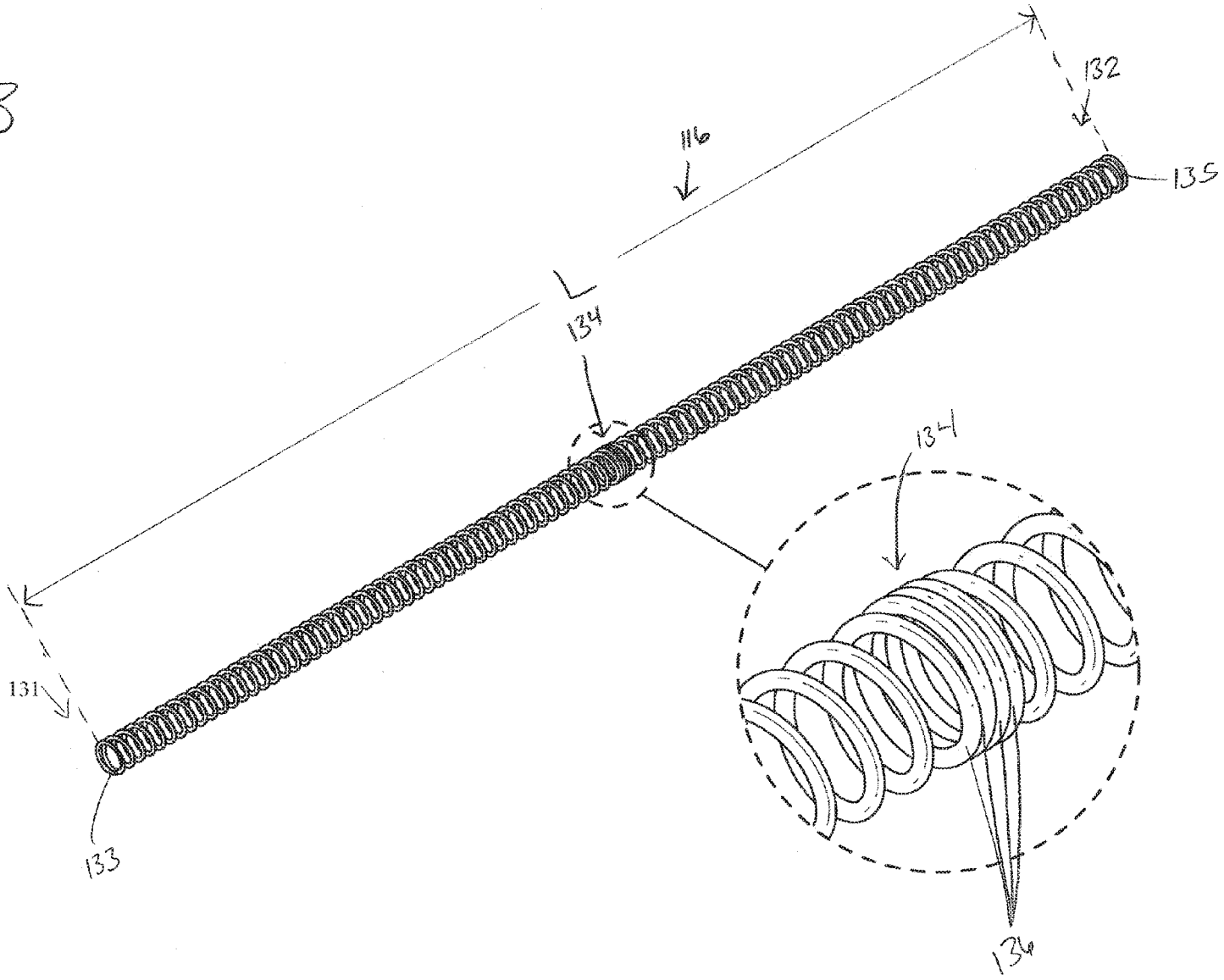
FIG. 3 illustrates a perspective view of a recoil spring, according to one embodiment of the present disclosure.
Figure 4:
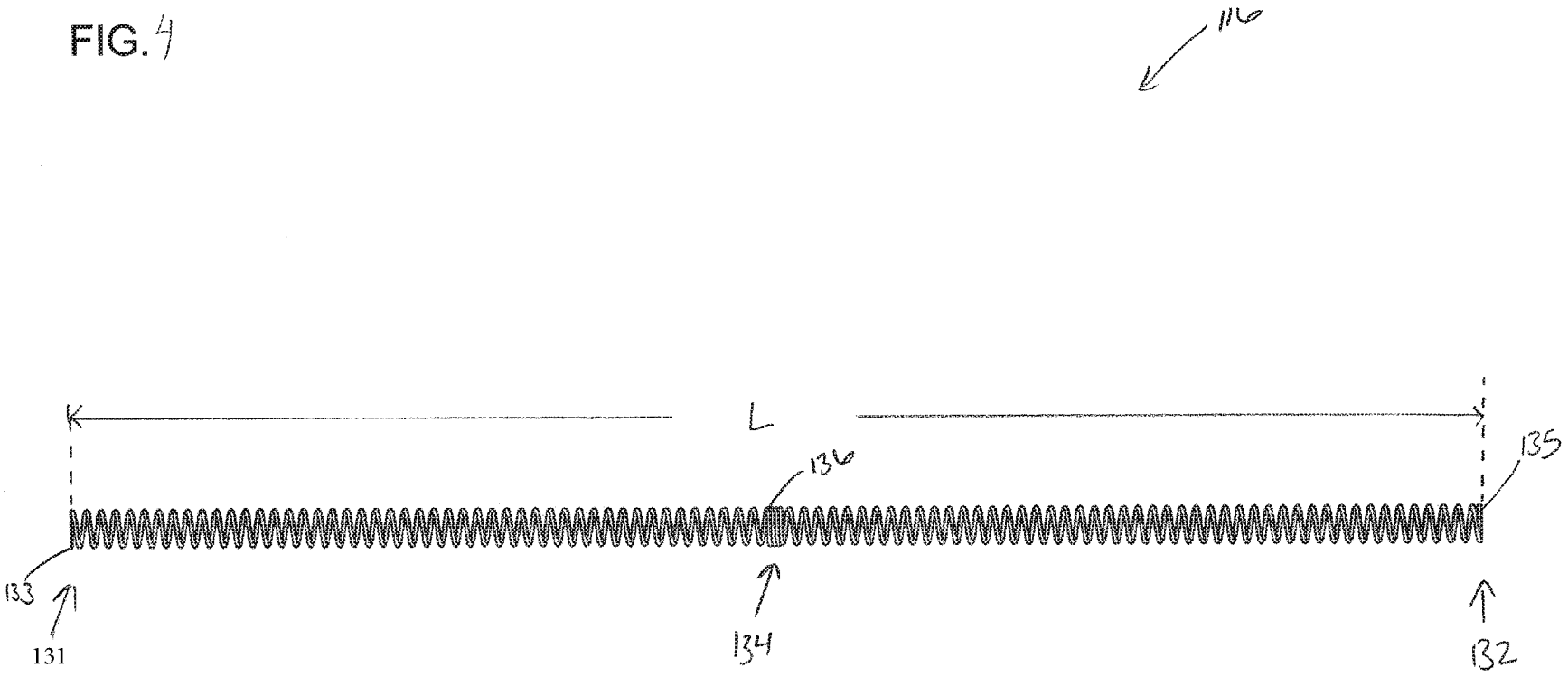
FIG. 4 illustrates a side view of the recoil spring shown in FIG. 3.

FIGS. 3-4 show the recoil spring 116 when the recoil spring is removed from the firearm 100. The recoil spring 116 includes a first end 131, a second end 132, and a dampened portion 134. The first end 131 of the recoil spring 116 is configured to receive a force from the bolt carrier 114 during the firing cycle. The second end 132 of the recoil spring 116 is configured to interface with the base 130 of the spring guide 118. Both the first and second ends 131, 132 include dead, flattened coils 133, 135 so as to allow the ends 131, 132 to interface with flat surfaces more steadily. In some embodiments, the ends 131, 132 can be open, closed, or closed ground.

The dampened portion 134 is positioned on the recoil spring 116 between the first end 131 and the second end 132. In some embodiments, the dampened portion 134 is positioned at about half way along a free length L (overall length of the spring measured when no load is applied) of the spring 116. The dampened portion 134 includes a plurality of dead coils 136. In some embodiments, the dampened portion 134 includes at least two dead coils 136. In some embodiments, the dampened portion 134 includes between about two dead coils 136 and about four dead coils 136. The dead coils 136 are inactive coils that are each in contact with one another.

In some embodiments, the recoil spring 116 is constructed of chrome silicon steel so as to make the spring impact and shock resistant. In other embodiments, the recoil spring 116 is constructed of carbon steel, music wire, chrome vanadium, chrome silicon, and 17-7 PH stainless steel.

A spring without dead coils (i.e., all coils are active coils) has a natural frequency. The dead coils 136 of the recoil spring 116 alter this natural frequency by affecting the harmonics of the spring 116. By altering the harmonics, the dead coils 136 help to slow the rate that the free length L of the spring is reduced over time. When a spring's free length L is reduced, the spring functions less reliably in the firearm 100. Therefore, slowing the rate at which this happens can increase a firearm's lifetime and reliability. Further, as the free length of the recoil spring reduces, so does the spring rate. As the spring rate reduces over time, the weaker the spring becomes. This can affect the timing and the rate at which the bolt carrier 114 cycles during a firing cycle.

In some embodiments, the spring 116 has a free length L between about 17 inches and about 17.125 inches. In some embodiments, the spring 116 has a solid length (when the spring 116 is completely compressed) of about 5.00 inches. In other embodiments, the spring 116 has a wire diameter of about 0.051. In other embodiments still, the spring 116 includes between about 95 coils and about 97 coils (both dead and active coils). In some embodiments, the recoil spring 116 has a spring rate of about 1.60 pounds.

Figure 5:
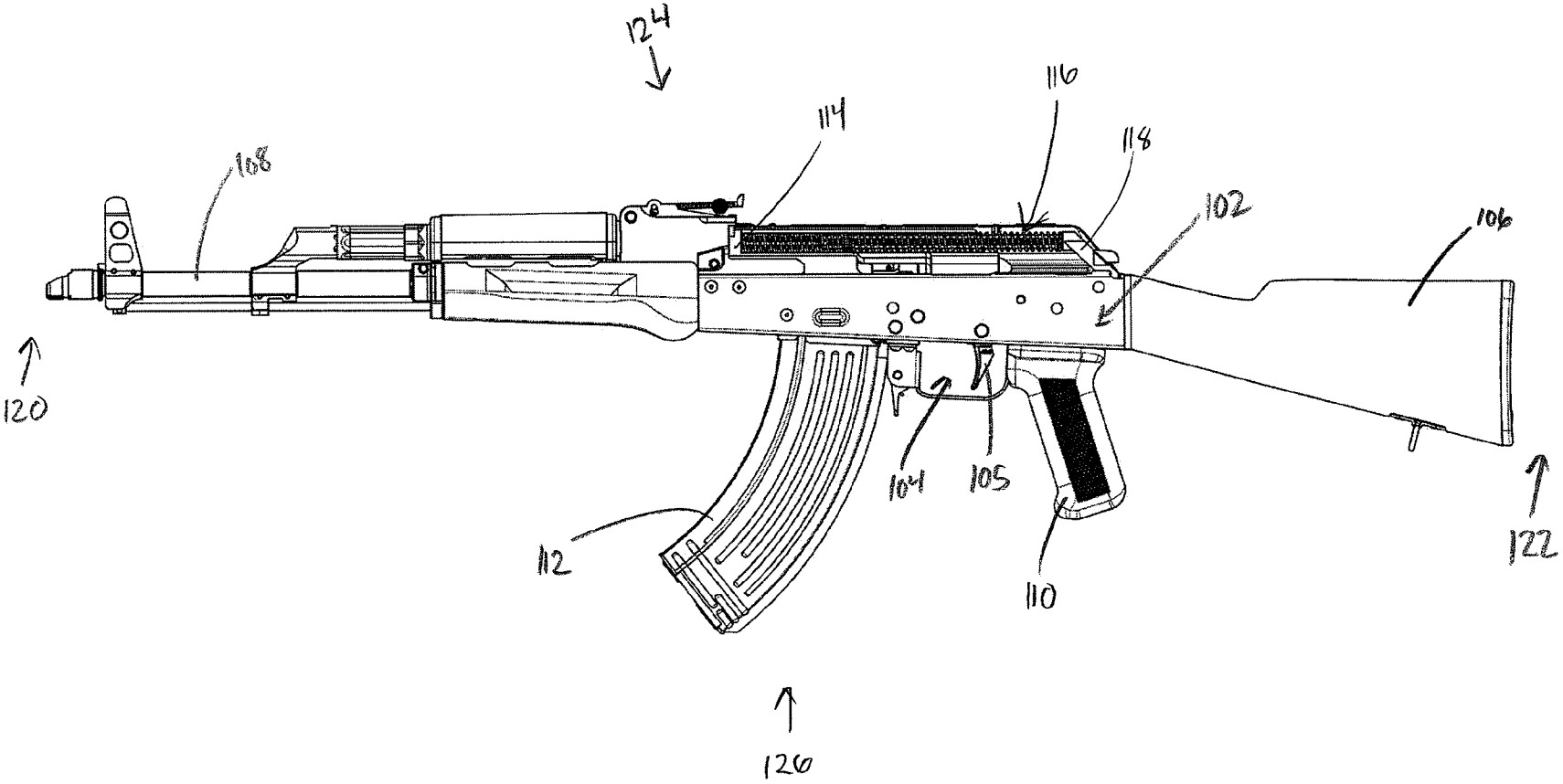
FIG. 5 illustrates a side view of the example firearm of FIG. 1 during a first point in a firing cycle.
Figure 6:
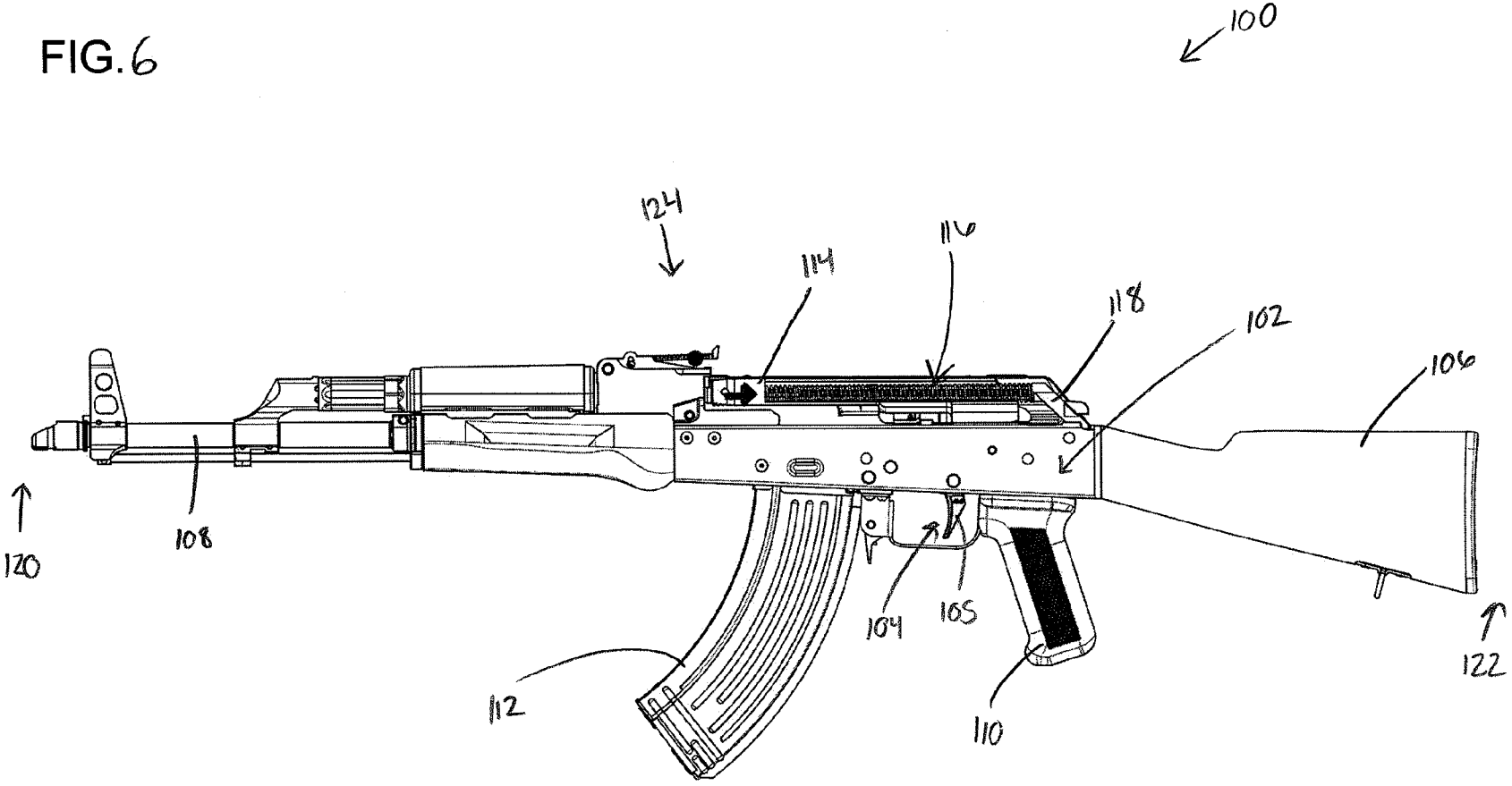
FIG. 6 illustrates a side view of the example firearm of FIG. 1 during a second point in the firing cycle.
Figure 7:
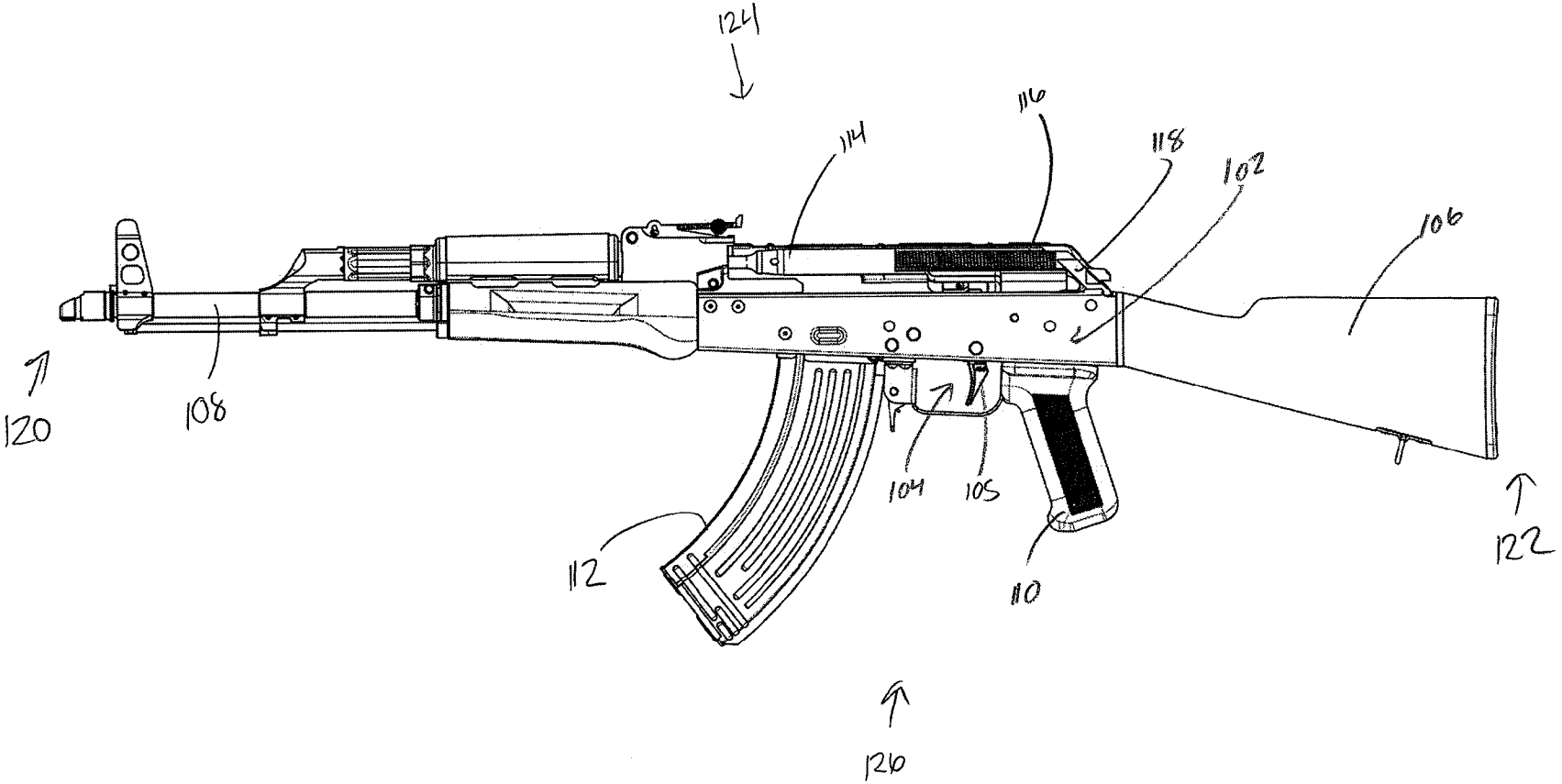
FIG. 7 illustrates a side view of the example firearm of FIG. 1 during a third point in the firing cycle.

FIGS. 5-7 show the firearm during different stages of the firing cycle. FIG. 5 shows the bolt carrier 114 and recoil spring 116 in the ready-to-fire position. Once the trigger mechanism 104 is activated (i.e., the trigger bow 105 is pulled), a round of ammunition is fired from the barrel 108. When the round of ammunition is fired, gases from this combustion process begin to force the bolt carrier 114 to the rear 122 of the firearm 100. As the bolt carrier 114 is moving toward the rear 122 of the firearm 100, the bolt carrier 114 rides over the spring guide rod 128 and begins to compress the recoil spring 116, as shown in FIG. 6. The bolt carrier 114 continues to travel to the rear 122 until the movement of the bolt carrier 114 has been stopped by an opposite force of the recoil spring 116. At this point, as shown in FIG. 7, the recoil spring 116 is at max compression. The recoil spring 116 then continues to exert a force on the bolt carrier 114 toward the front 120 of the firearm, thereby forcing the bolt carrier 114 back in a direction toward the front 120 of the firearm 100 until the bolt carrier 114 again reaches the ready-to-fire position that is shown in FIG. 5.

In other embodiments, a recoil spring with dead coils, similar to the one described above, can be installed a buffer tube assembly of an AR-15 type rifle. In such an embodiment, the spring is installed in the buffer tube, which retains the spring in the firearm. Similar to the spring 116 described above, the spring used in a buffer tube assembly receives energy from a bolt carrier assembly that is positioned within a receiver of the firearm and functions to return that bolt carrier assembly back to a ready-to-fire position at the end of the firing cycle. A recoiled spring with dead coils is also advantageous in an AR-15 application, as a spring with a longer, more reliable lifetime improves the operation of the firearm.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A firearm comprising:

a receiver for housing a trigger mechanism, the receiver being attached to a firearm barrel, the receiver including a bolt carrier configured to reciprocate therein;

a recoil spring having a first end and a second end, the first end interfacing with the bolt carrier, the recoil spring further including a dampened portion positioned between the first and second ends, the dampened portion having a plurality of inactive spring coils, wherein the dampened portion is abutted on both sides by active coils; and a spring retainer being configured to retain the recoil spring within the firearm.

2. The firearm of claim 1, wherein the spring retainer is a spring guide that includes a base and a spring guide rod, the spring guide rod being positioned within the spring, and the base being mounted to the receiver, and wherein the second end of the recoil spring interfaces with the base.

3. The firearm of claim 1, wherein the recoil spring includes between about two and about four inactive coils.

4. The firearm of claim 1, wherein the dampened portion of the recoil spring is positioned about halfway between the first and second ends of the recoil spring.

5. The firearm of claim 1, wherein the recoil spring is manufactured from chrome silicon steel.

6. The firearm of claim 1, wherein the recoil spring has a free length of between about 17 inches and about 17.125 inches.

7. A recoil spring assembly for a firearm comprising:

a spring guide having a base and a spring guide rod, the spring guide rod being attached at and extending away from the base, wherein the base is configured to be mounted to a firearm; and a recoil spring being positioned around the spring guide rod, the recoil spring having a first end and a second end, the first end being retained around the spring guide rod by way of a fastener secured to the spring guide rod, and the second end of the recoil spring interfacing with the base of the spring guide, the recoil spring further including a dampened portion positioned between the first and second ends, wherein the dampened portion includes a plurality of inactive spring coils, and wherein the dampened portion is abutted on both sides by active coils.

8. The assembly of claim 7, wherein the recoil spring includes between about two and about four inactive coils.

9. The assembly of claim 7, wherein the dampened portion of the recoil spring is positioned about halfway between the first and second ends of the recoil spring.

10. The assembly of claim 7, wherein the recoil spring is manufactured from chrome silicon steel.

11. The assembly of claim 7, wherein the recoil spring has a free length of between about 17 inches and about 17.125 inches.

* * * * *